US008702257B2

(12) United States Patent
Lenk et al.

(10) Patent No.: US 8,702,257 B2
(45) **Date of Patent: *Apr. 22, 2014**

(54) PLASTIC LED BULB

(75) Inventors: Ronald J. Lenk, Redwood City, CA (US); Carol Lenk, Redwood City, CA (US); Daniel Chandler, Menlo Park, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 784 days.

This patent is subject to a terminal disclaimer.

(21) Appl. No.: 12/299,049

(22) PCT Filed: Apr. 27, 2007

(86) PCT No.: PCT/US2007/010469

§ 371 (c)(1),
(2), (4) Date: May 13, 2009

(87) PCT Pub. No.: WO2007/130358

PCT Pub. Date: Nov. 15, 2007

(65) Prior Publication Data

US 2009/0257220 A1 Oct. 15, 2009

Related U.S. Application Data

(60) Provisional application No. 60/797,146, filed on May 2, 2006.

(51) Int. Cl.

| | |
|---|---|
| ***F21V 9/16*** | (2006.01) |
| ***F21V 3/04*** | (2006.01) |
| ***F21V 9/12*** | (2006.01) |
| ***F21V 5/00*** | (2006.01) |
| ***H01R 33/22*** | (2006.01) |
| ***H01J 9/395*** | (2006.01) |

(52) U.S. Cl.

CPC ... *F21V 9/16* (2013.01); *F21V 9/12* (2013.01); *F21V 3/0463* (2013.01); *F21V 5/00* (2013.01); *H01R 33/22* (2013.01); *F21V 3/0445* (2013.01); *H01J 9/395* (2013.01)

USPC ..... 362/84; 362/293; 362/294; 362/311.02; 362/318; 362/355; 362/650; 445/53

(58) Field of Classification Search

USPC ..... 362/84, 96, 186, 293, 311.01–311.04, 362/311.13–311.15, 318, 355, 363, 800, 362/218, 294, 373, 650, 260; 313/498–512, 313/46

See application file for complete search history.

(56) References Cited

U.S. PATENT DOCUMENTS

| | | | |
|---|---|---|---|
| 3,962,675 | A | 6/1976 | Rowley et al. |
| 4,025,290 | A | 5/1977 | Giangiulio |

(Continued)

FOREIGN PATENT DOCUMENTS

| | | |
|---|---|---|
| EP | 0658933 B1 | 10/2001 |
| JP | 63-086484 | 4/1988 |

(Continued)

OTHER PUBLICATIONS

Office Action received for CN Patent Application No. 200780015112.2, mailed on Apr. 8, 2010, 9 pages of Office Action and 16 pages of English Translation.

(Continued)

*Primary Examiner* — Alan Cariaso
(74) *Attorney, Agent, or Firm* — Morrison & Foerster LLP

(57) ABSTRACT

An LED bulb having a bulb-shaped shell, a thermally conductive plastic material within the bulb-shaped shell, and at least one LED within the bulb-shaped shell. The bulb also includes a base, wherein the base is dimensioned to be received within a standard electrical socket.

22 Claims, 4 Drawing Sheets

(56) References Cited

U.S. PATENT DOCUMENTS 4,039,885 A 8/1977 van Boekhold et al.
4,077,076 A 3/1978 Masters
4,211,955 A 7/1980 Ray
4,271,458 A 6/1981 George, Jr.
4,290,095 A 9/1981 Schmidt
4,325,107 A 4/1982 MacLeod
4,336,855 A 6/1982 Chen
4,346,329 A 8/1982 Schmidt
4,405,744 A 9/1983 Greinecker
4,511,952 A 4/1985 Vanbragt
4,539,516 A 9/1985 Thompson
4,611,512 A 9/1986 Honda
4,647,331 A 3/1987 Koury, Jr. et al.
4,650,509 A 3/1987 Vanbragt
4,656,564 A 4/1987 Felder
4,658,532 A 4/1987 McFarland et al.
4,663,558 A 5/1987 Endo
4,727,289 A 2/1988 Uchida
4,728,999 A 3/1988 Dannatt et al.
4,840,383 A 6/1989 Lombardo
4,843,266 A 6/1989 Szanto et al.
4,875,852 A 10/1989 Ferren
4,876,632 A 10/1989 Osterhout et al.
4,904,991 A 2/1990 Jones
4,916,352 A 4/1990 Haim
4,942,685 A 7/1990 Lin
4,947,300 A 8/1990 Wen
4,967,330 A 10/1990 Bell
4,994,705 A 2/1991 Linder et al.
5,008,588 A 4/1991 Nakahara
5,065,226 A 11/1991 Kluitmans et al.
5,065,291 A 11/1991 Frost et al.
5,075,372 A 12/1991 Hille et al.
5,119,831 A 6/1992 Robin et al.
5,136,213 A 8/1992 Sacchetti
5,140,220 A 8/1992 Hasegawa
5,224,773 A 7/1993 Arimura
5,237,490 A 8/1993 Ferng
5,303,124 A 4/1994 Wrobel
5,358,880 A 10/1994 Lebby et al.
5,377,000 A 12/1994 Berends
5,405,208 A 4/1995 Hsieh
5,463,280 A 10/1995 Johnson
5,493,184 A 2/1996 Wood et al.
5,514,627 A 5/1996 Lowery
5,528,474 A 6/1996 Roney
5,561,347 A 10/1996 Nakamura et al.
5,585,783 A 12/1996 Hall
5,622,423 A 4/1997 Lee
5,630,660 A 5/1997 Chen
5,632,551 A 5/1997 Roney et al.
5,662,490 A 9/1997 Ogawa
5,664,866 A 9/1997 Reniger et al.
5,667,295 A 9/1997 Tsui
5,684,354 A 11/1997 Gleckman
5,685,637 A 11/1997 Chapman et al.
5,688,042 A 11/1997 Madadi et al.
5,726,535 A 3/1998 Yan
5,803,588 A * 9/1998 Costa ..... 362/223
5,807,157 A 9/1998 Penjuke
5,813,753 A 9/1998 Vriens et al.
5,887,967 A 3/1999 Chang
5,890,794 A 4/1999 Abtahi et al.
5,892,325 A 4/1999 Gleckman
5,899,557 A 5/1999 McDermott
5,929,568 A 7/1999 Eggers
5,931,562 A 8/1999 Arato
5,931,570 A 8/1999 Yamuro
5,936,599 A 8/1999 Reymond
5,941,626 A 8/1999 Yamuro
5,947,588 A 9/1999 Huang
5,952,916 A 9/1999 Yamabe
5,963,126 A 10/1999 Karlin et al.
5,982,059 A 11/1999 Anderson
5,984,494 A 11/1999 Chapman et al.
6,003,033 A 12/1999 Amano et al.
6,043,591 A 3/2000 Gleckman
6,066,861 A 5/2000 Hohn et al.
6,087,764 A 7/2000 Matei
6,095,671 A 8/2000 Hutain
6,102,809 A 8/2000 Nichols
6,120,312 A 9/2000 Shu
6,123,631 A 9/2000 Ginder
6,147,367 A 11/2000 Yang et al.
6,158,451 A 12/2000 Wu
6,183,310 B1 2/2001 Shu
6,184,628 B1 2/2001 Ruthenberg
6,227,679 B1 * 5/2001 Zhang et al. ..... 362/236
6,227,685 B1 5/2001 McDermott
6,254,939 B1 7/2001 Cowan
6,258,699 B1 7/2001 Chang et al.
6,268,801 B1 7/2001 Wu
6,273,580 B1 8/2001 Coleman et al.
6,276,822 B1 8/2001 Bedrosian et al.
6,313,892 B2 11/2001 Gleckman
6,316,911 B1 11/2001 Moskowitz et al.
6,332,692 B1 12/2001 McCurdy
6,338,647 B1 1/2002 Fernandez et al.
6,357,902 B1 3/2002 Horowitz
6,382,582 B1 5/2002 Brown
6,426,704 B1 7/2002 Hutchison
6,471,562 B1 10/2002 Liu
6,478,449 B2 11/2002 Lee et al.
6,480,389 B1 * 11/2002 Shie et al. ..... 361/707
6,488,392 B1 12/2002 Lu
6,496,237 B1 12/2002 Gleckman
6,504,301 B1 1/2003 Lowery
6,513,955 B1 2/2003 Waltz
6,528,954 B1 3/2003 Lys et al.
6,534,988 B2 3/2003 Flory, IV
6,541,800 B2 4/2003 Barnett et al.
6,547,417 B2 * 4/2003 Lee ..... 362/249.01
6,568,834 B1 5/2003 Scianna
6,582,100 B1 6/2003 Hochstein
6,608,272 B2 8/2003 Garcia
6,612,712 B2 9/2003 Nepil
6,619,829 B1 9/2003 Chen
6,626,557 B1 9/2003 Taylor
6,639,360 B2 10/2003 Roberts
6,655,810 B2 12/2003 Hayashi et al.
6,659,632 B2 12/2003 Chen
6,685,852 B2 2/2004 Setlur
6,709,132 B2 3/2004 Ishibashi
6,711,426 B2 3/2004 Benaron et al.
6,713,961 B2 3/2004 Honda et al.
6,734,633 B2 5/2004 Matsuba et al.
6,741,029 B2 5/2004 Matsubara et al.
6,742,907 B2 6/2004 Funamoto et al.
6,746,885 B2 6/2004 Cao
6,750,824 B1 6/2004 Shen
6,773,192 B1 8/2004 Chao
6,786,625 B2 9/2004 Wesson
6,789,348 B1 9/2004 Kneller et al.
6,791,259 B1 9/2004 Stokes et al.
6,791,283 B2 9/2004 Bowman et al.
6,793,362 B2 9/2004 Tai
6,793,363 B2 9/2004 Jensen
6,796,698 B2 9/2004 Sommers et al.
6,805,461 B2 10/2004 Witte
6,819,049 B1 11/2004 Bohmer et al.
6,819,056 B2 11/2004 Lin
6,828,590 B2 12/2004 Hsiung
6,842,204 B1 1/2005 Johnson
6,864,513 B2 3/2005 Lin et al.
6,864,554 B2 3/2005 Lin
6,881,980 B1 4/2005 Ting
6,886,963 B2 5/2005 Lodhie
6,903,380 B2 6/2005 Barnett et al.
6,905,231 B2 6/2005 Dickie
6,910,794 B2 6/2005 Rice
6,911,678 B2 6/2005 Fujisawa et al.
6,911,915 B2 6/2005 Wu et al.
6,926,973 B2 8/2005 Suzuki et al.
6,927,683 B2 8/2005 Sugimoto et al.

(56) References Cited

U.S. PATENT DOCUMENTS 6,932,638 B1 8/2005 Burrows et al.
6,936,857 B2 8/2005 Doxsee et al.
6,943,357 B2 9/2005 Srivastava et al.
6,948,829 B2 9/2005 Verdes et al.
6,956,243 B1 10/2005 Chin
6,963,688 B2 11/2005 Nath
6,964,878 B2 11/2005 Horng et al.
6,967,445 B1 11/2005 Jewell et al.
6,971,760 B2 12/2005 Archer et al.
6,974,924 B2 12/2005 Agnatovech et al.
6,982,518 B2 1/2006 Chou et al.
6,983,506 B1 1/2006 Brown
7,022,260 B2 * 4/2006 Morioka ..... 252/301.4 R
7,042,150 B2 5/2006 Yasuda
7,058,103 B2 6/2006 Ishida et al.
D525,374 S 7/2006 Maxik et al.
7,073,920 B2 7/2006 Konkle, Jr. et al.
7,074,631 B2 7/2006 Erchak et al.
7,075,112 B2 7/2006 Roberts
7,078,732 B1 * 7/2006 Reeh et al. ..... 257/98
D527,119 S 8/2006 Maxik et al.
7,086,756 B2 8/2006 Maxik
7,086,767 B2 8/2006 Sidwell
D528,673 S 9/2006 Maxik et al.
D531,740 S 11/2006 Maxik
D532,532 S 11/2006 Maxik
7,138,666 B2 11/2006 Erchak et al.
7,161,311 B2 * 1/2007 Mueller et al. ..... 315/294
7,186,016 B2 3/2007 Jao
7,213,934 B2 5/2007 Zarian
7,239,080 B2 7/2007 Ng et al.
7,241,039 B2 7/2007 Hulse
7,246,919 B2 7/2007 Porchia
7,261,454 B2 8/2007 Ng
7,264,527 B2 9/2007 Bawendi et al.
7,270,446 B2 9/2007 Chang
7,288,798 B2 10/2007 Chang
7,315,119 B2 1/2008 Ng
7,319,293 B2 1/2008 Maxik
7,344,279 B2 3/2008 Mueller et al.
7,350,933 B2 * 4/2008 Ng et al. ..... 362/84
7,367,692 B2 5/2008 Maxik
7,396,142 B2 * 7/2008 Laizure et al. ..... 362/240
7,489,031 B2 2/2009 Roberts
7,513,669 B2 * 4/2009 Chua et al. ..... 362/606
7,524,097 B2 4/2009 Turnbull et al.
7,550,319 B2 6/2009 Wang et al.
7,677,765 B2 * 3/2010 Tajul et al. ..... 362/294
7,884,544 B2 2/2011 Takezawa et al.
8,075,172 B2 12/2011 Davey et al.
8,154,190 B2 4/2012 Ishii et al.
2001/0008436 A1 7/2001 Gleckman
2001/0009400 A1 7/2001 Maeno et al.
2001/0019134 A1 9/2001 Chang et al.
2001/0026447 A1 10/2001 Herrera
2001/0035264 A1 * 11/2001 Padmanabhan ..... 156/300
2001/0053077 A1 12/2001 Anwly-Davies et al.
2002/0021573 A1 2/2002 Zhang
2002/0039872 A1 4/2002 Asai et al.
2002/0068775 A1 * 6/2002 Munzenberger ..... 524/2
2002/0070449 A1 6/2002 Yagi et al.
2002/0085379 A1 7/2002 Han et al.
2002/0093287 A1 7/2002 Chen
2002/0097586 A1 7/2002 Horowitz
2002/0117692 A1 8/2002 Lin
2002/0126491 A1 9/2002 Chen
2002/0145863 A1 10/2002 Stultz
2002/0149312 A1 10/2002 Roberts et al.
2002/0153829 A1 10/2002 Asai et al.
2002/0154499 A1 10/2002 Hsieh
2002/0176246 A1 11/2002 Chen
2002/0183438 A1 * 12/2002 Amarasekera et al. ..... 524/495
2002/0186538 A1 12/2002 Kase et al.
2002/0191416 A1 12/2002 Wesson
2003/0025449 A1 2/2003 Rossner
2003/0038596 A1 2/2003 Ho
2003/0043579 A1 3/2003 Rong et al.
2003/0048632 A1 3/2003 Archer
2003/0058658 A1 3/2003 Lee
2003/0072156 A1 4/2003 Pohlert
2003/0079387 A1 5/2003 Derose
2003/0111955 A1 6/2003 McNulty et al.
2003/0128629 A1 7/2003 Stevens
2003/0142508 A1 7/2003 Lee
2003/0164666 A1 9/2003 Crunk
2003/0185020 A1 10/2003 Stekelenburg
2003/0193841 A1 10/2003 Crunk
2003/0201903 A1 10/2003 Shen
2003/0214233 A1 11/2003 Takahashi et al.
2003/0230045 A1 12/2003 Krause, Sr. et al.
2003/0231510 A1 12/2003 Tawa et al.
2004/0001338 A1 1/2004 Pine
2004/0004435 A1 1/2004 Hsu
2004/0004441 A1 1/2004 Yano
2004/0007980 A1 1/2004 Shibata
2004/0008525 A1 1/2004 Shibata
2004/0014414 A1 1/2004 Horie et al.
2004/0039274 A1 2/2004 Benaron et al.
2004/0039764 A1 2/2004 Gonikberg et al.
2004/0056600 A1 3/2004 Lapatovich et al.
2004/0085017 A1 5/2004 Lee
2004/0085758 A1 5/2004 Deng
2004/0101802 A1 5/2004 Scott
2004/0105262 A1 6/2004 Tseng et al.
2004/0113549 A1 6/2004 Roberts et al.
2004/0114352 A1 6/2004 Jensen
2004/0114367 A1 6/2004 Li
2004/0125034 A1 7/2004 Shen
2004/0125515 A1 7/2004 Popovich
2004/0127138 A1 7/2004 Huang
2004/0173810 A1 9/2004 Lin et al.
2004/0179355 A1 9/2004 Gabor
2004/0183458 A1 9/2004 Lee
2004/0187313 A1 9/2004 Zirk et al.
2004/0189262 A1 9/2004 McGrath
2004/0190305 A1 9/2004 Arik et al.
2004/0201673 A1 10/2004 Asai
2004/0207334 A1 10/2004 Lin
2004/0208002 A1 10/2004 Wu
2004/0211589 A1 * 10/2004 Chou et al. ..... 174/253
2004/0217693 A1 11/2004 Duggal et al.
2004/0233661 A1 11/2004 Taylor
2004/0245912 A1 12/2004 Thurk
2004/0257804 A1 12/2004 Lee
2004/0264192 A1 12/2004 Nagata et al.
2005/0007010 A1 1/2005 Lee
2005/0007770 A1 1/2005 Bowman et al.
2005/0014817 A1 1/2005 Compere et al.
2005/0015029 A1 1/2005 Kim
2005/0018424 A1 1/2005 Popovich
2005/0023540 A1 2/2005 Yoko et al.
2005/0030761 A1 2/2005 Burgess
2005/0031281 A1 2/2005 Nath
2005/0036299 A1 2/2005 Tsai
2005/0036616 A1 2/2005 Huang et al.
2005/0047170 A1 3/2005 Hilburger et al.
2005/0052885 A1 3/2005 Wu
2005/0057187 A1 3/2005 Catalano
2005/0063185 A1 3/2005 Monjo
2005/0067343 A1 * 3/2005 Zulauf et al. ..... 210/443
2005/0068776 A1 3/2005 Ge
2005/0084229 A1 4/2005 Babbitt et al.
2005/0099787 A1 5/2005 Hayes
2005/0105302 A1 5/2005 Hofmann et al.
2005/0110191 A1 5/2005 Lin
2005/0110384 A1 * 5/2005 Peterson ..... 313/318.01
2005/0111234 A1 5/2005 Martin et al.
2005/0129979 A1 6/2005 Kambe et al.
2005/0141221 A1 6/2005 Yu
2005/0151664 A1 7/2005 Kolish et al.
2005/0152136 A1 7/2005 Konkle, Jr. et al.
2005/0162101 A1 7/2005 Leong et al.
2005/0162864 A1 * 7/2005 Verdes et al. ..... 362/555
2005/0174065 A1 8/2005 Janning

(56) References Cited

U.S. PATENT DOCUMENTS

| | | | | |
|---|---|---|---|---|
| 2005/0174769 | A1 | 8/2005 | Yong et al. | |
| 2005/0174780 | A1* | 8/2005 | Park | 362/294 |
| 2005/0179358 | A1 | 8/2005 | Soules et al. | |
| 2005/0179379 | A1 | 8/2005 | Kim | |
| 2005/0180136 | A9 | 8/2005 | Popovich | |
| 2005/0180137 | A1 | 8/2005 | Hsu | |
| 2005/0190561 | A1 | 9/2005 | Ng et al. | |
| 2005/0207152 | A1 | 9/2005 | Maxik | |
| 2005/0207159 | A1 | 9/2005 | Maxik | |
| 2005/0217996 | A1* | 10/2005 | Liu et al. | 204/603 |
| 2005/0224829 | A1 | 10/2005 | Negley | |
| 2005/0230691 | A1* | 10/2005 | Amiotti et al. | 257/79 |
| 2005/0233485 | A1* | 10/2005 | Shishov et al. | 438/25 |
| 2005/0237005 | A1 | 10/2005 | Maxik | |
| 2005/0243539 | A1 | 11/2005 | Evans et al. | |
| 2005/0243550 | A1 | 11/2005 | Stekelenburg | |
| 2005/0243552 | A1 | 11/2005 | Maxik | |
| 2005/0255026 | A1 | 11/2005 | Barker et al. | |
| 2005/0258446 | A1 | 11/2005 | Raos et al. | |
| 2005/0259419 | A1 | 11/2005 | Sandoval | |
| 2005/0265039 | A1 | 12/2005 | Lodhie et al. | |
| 2005/0270780 | A1 | 12/2005 | Zhang | |
| 2005/0276034 | A1 | 12/2005 | Malpetti | |
| 2005/0276051 | A1 | 12/2005 | Caudle et al. | |
| 2005/0276053 | A1 | 12/2005 | Mueller | |
| 2005/0276072 | A1 | 12/2005 | Hayashi et al. | |
| 2005/0285494 | A1* | 12/2005 | Cho et al. | 313/112 |
| 2006/0002110 | A1 | 1/2006 | Dowling | |
| 2006/0002125 | A1 | 1/2006 | Kim et al. | |
| 2006/0007410 | A1 | 1/2006 | Masuoka | |
| 2006/0022214 | A1 | 2/2006 | Morgan et al. | |
| 2006/0034077 | A1 | 2/2006 | Chang | |
| 2006/0044803 | A1 | 3/2006 | Edwards | |
| 2006/0050514 | A1* | 3/2006 | Opolka | 362/294 |
| 2006/0061985 | A1 | 3/2006 | Elkins | |
| 2006/0071591 | A1* | 4/2006 | Takezawa et al. | 313/501 |
| 2006/0092644 | A1* | 5/2006 | Mok et al. | 362/327 |
| 2006/0145172 | A1 | 7/2006 | Su | |
| 2006/0152946 | A1 | 7/2006 | Chien | |
| 2006/0158886 | A1 | 7/2006 | Lee | |
| 2006/0176699 | A1 | 8/2006 | Crunk | |
| 2006/0187653 | A1 | 8/2006 | Olsson et al. | |
| 2006/0193121 | A1* | 8/2006 | Kamoshita | 362/84 |
| 2006/0193130 | A1* | 8/2006 | Ishibashi | 362/227 |
| 2006/0198147 | A1 | 9/2006 | Ge | |
| 2006/0208260 | A1 | 9/2006 | Sakuma | |
| 2006/0226772 | A1 | 10/2006 | Tan et al. | |
| 2006/0243997 | A1 | 11/2006 | Yang | |
| 2006/0250802 | A1 | 11/2006 | Herold | |
| 2006/0255353 | A1 | 11/2006 | Taskar | |
| 2006/0261359 | A1 | 11/2006 | Huang | |
| 2006/0273340 | A1 | 12/2006 | Lv | |
| 2006/0274524 | A1 | 12/2006 | Chang et al. | |
| 2006/0289884 | A1* | 12/2006 | Soules et al. | 257/98 |
| 2007/0018181 | A1 | 1/2007 | Steen | |
| 2007/0031685 | A1 | 2/2007 | Ko et al. | |
| 2007/0057364 | A1 | 3/2007 | Wang | |
| 2007/0086189 | A1 | 4/2007 | Raos | |
| 2007/0090391 | A1 | 4/2007 | Diamantidis | |
| 2007/0090737 | A1 | 4/2007 | Hu et al. | |
| 2007/0120879 | A1 | 5/2007 | Kanade | |
| 2007/0125982 | A1 | 6/2007 | Tian | |
| 2007/0139949 | A1 | 6/2007 | Tanda | |
| 2007/0153518 | A1 | 7/2007 | Chen | |
| 2007/0291490 | A1 | 12/2007 | Tajul | |
| 2008/0013316 | A1 | 1/2008 | Chiang | |
| 2008/0048200 | A1 | 2/2008 | Mueller | |
| 2008/0070331 | A1 | 3/2008 | Ke | |
| 2008/0185600 | A1 | 8/2008 | Thomas | |
| 2009/0001372 | A1 | 1/2009 | Arik et al. | |
| 2009/0256167 | A1 | 10/2009 | Peeters et al. | |
| 2009/0324875 | A1* | 12/2009 | Heikkila | 428/99 |
| 2010/0177534 | A1* | 7/2010 | Ryu et al. | 362/606 |

FOREIGN PATENT DOCUMENTS

| | | | |
|---|---|---|---|
| JP | 07-99372 | A | 4/1995 |
| JP | 3351103 | B2 | 11/2002 |
| WO | 02/061805 | A2 | 8/2002 |
| WO | WO 2004/100213 | | 11/2004 |
| WO | 2005/060309 | A2 | 6/2005 |
| WO | 2007/069119 | A1 | 6/2007 |
| WO | 2007/130357 | A2 | 11/2007 |
| WO | 2007/130359 | A2 | 11/2007 |
| WO | 2009/054948 | A1 | 4/2009 |

OTHER PUBLICATIONS

Office Action received for NZ Patent Application No. 573336, mailed on Apr. 19, 2010, 2 pages.

Office Action received for Chinese Patent Application No. 200780015112.2, mailed on Apr. 8, 2010, 9 pages of Office Action and 16 pages of English Translation.

International Preliminary Report on Patentability for PCT Patent Application No. PCT/US2008/011365, mailed on Apr. 15, 2008, 7 pages.

International Search Report and Written Opinion received for PCT Patent Application No. PCT/US2008/011365, mailed on Dec. 5, 2008, 6 pages.

International Preliminary Report on Patentability received for PCT Patent Application No. PCT/US2008/011984, mailed on May 6, 2010, 5 pages.

International Search Report and Written Opinion received for PCT Patent Application No. PCT/US2008/011984, mailed on Jan. 15, 2009, 6 pages.

Ryu et al., "Liquid Crystalline Assembly of Rod-Coil Molecules", Structure & Bonding, vol. 128, 2008, pp. 63-98.

International Search Report dated Aug. 7, 2008 issued in International Application No. PCT/US2007/10469.

Preliminary Examination Report on Patentability dated Nov. 4, 2008 issued in International Application No. PCT/US2007/10469.

Non Final Office Action received for U.S. Appl. No. 12/299,003, mailed on Apr. 15, 2011, 60 pages.

Final Office Action received for U.S. Appl. No, 12/299,088, mailed on May 13, 2011, 26 pages.

Final Office Action received for U.S. Appl. No. 12/299,003, mailed on Oct. 5, 2011, 16 pages.

Notice of Allowance received for U.S. Appl. No. 12/299,088, mailed on Apr. 3, 2012, 15 pages.

Non Final Office Action received for U.S. Appl. No. 12/739,944, mailed on May 16, 2012, 55 pages.

Non Final Office Action received for U.S. Appl. No. 12/299,003 mailed on Jun. 13, 2012, 23 pages.

Non Final Office Action received for U.S. Appl. No. 13/476,986, mailed on Aug. 30, 2012, 53 pages.

Extended European Search Report received for European Patent Application No. 08842545.9, mailed on Jul. 26, 2012, 7 pages.

Non Final Office Action received for U. S. Appl. No. 12/681,774, mailed on Oct. 4, 2012, 52 pages.

Supplementary European Search Report and Search Opinion received for European Patent Application No. 07756165.2, mailed on Sep. 22, 2011, 6 pages.

Non Final Office Action received for U.S. Appl. No. 13/476,986, mailed on Jan. 18, 2013, 11 pages.

* cited by examiner

PLASTIC LED BULB

CROSS-REFERENCE TO RELATED APPLICATION

This application is filed under 35 U.S.C. §371 and claims priority to International Application Serial No. PCT/US2007/010469, filed Apr. 27, 2007, which claims priority to U.S. Patent Provisional Application No. 60/797,146 filed May 2, 2006 which is incorporated herein by this reference in its entirety.

FIELD OF THE INVENTION

The present invention relates to replacement of bulbs used for lighting by light emitting diode (LED) bulbs, and more particularly, to the efficient removal of the heat generated by the LEDs in order to permit the replacement bulb to match the light output of the bulb being replaced.

BACKGROUND OF THE INVENTION

An LED consists of a semiconductor junction, which emits light due to a current flowing through the junction. At first sight, it would seem that LEDs should be able to make an excellent replacement for the traditional tungsten filament incandescent bulb. At equal power, they give far more light output than do incandescent bulbs, or, what is the same thing, they use much less power for equal light; and their operational life is orders of magnitude larger, namely, 10-100 thousand hours vs. 1-2 thousand hours.

However, LEDs have a number of drawbacks that have prevented them, so far, from being widely adopted as incandescent replacements. Among the chief of these is that, although LEDs require substantially less power for a given light output than do incandescent bulbs, it still takes many watts to generate adequate light for illumination. Whereas the tungsten filament in an incandescent bulb operates at a temperature of approximately 3000° (degrees) K, an LED, being a semiconductor, cannot be allowed to get hotter than approximately 120° C. The LED thus has a substantial heat problem: If operated in vacuum like an incandescent, or even in air, it would rapidly get too hot and fail. This has limited available LED bulbs to very low power (i.e., less than approximately 3W), producing insufficient illumination for incandescent replacements.

One possible solution to this problem is to use a large metallic heat sink, attached to the LEDs. This heat sink would then extend out away from the bulb, removing the heat from the LEDs. This solution is undesirable, and in fact has not been tried, because of the common perception that customers will not use a bulb that is shaped radically differently from the traditionally shaped incandescent bulb; and also from the consideration that the heat sink may make it impossible for the bulb to fit in to pre-existing fixtures.

This invention has the object of developing a light emitting apparatus utilizing light emitting diodes (LEDs), such that the above-described primary problem is effectively solved. It aims at providing a replacement bulb for incandescent lighting having a plurality of LEDs with a light output equal in intensity to that of an incandescent bulb, and whose dissipated power may be effectively removed from the LEDs in such a way that their maximum rated temperature is not exceeded. The apparatus includes a bulb-shaped shell, preferably formed of a plastic such as polycarbonate. The shell may be transparent, or may contain materials dispersed in it to disperse the light, making it appear not to have point sources of light, and may also contain materials dispersed in it to change the bluish color of the LED light to more yellowish color, more closely resembling the light from normal incandescent bulbs.

SUMMARY OF THE INVENTION

In accordance with one embodiment, an LED bulb comprises: a bulb-shaped shell; a thermally conductive plastic material within the bulb-shaped shell; at least one LED within the bulb-shaped shell; and a base, wherein the base is dimensioned to be received within an electrical socket.

In accordance with another embodiment, a method of manufacturing an LED bulb comprises: creating a plastic bulb-shaped shell; filling the shell with a plastic material, wherein the plastic material is thermally conductive; installing at least one LED in the plastic material prior to curing the plastic material; and curing the plastic material.

In accordance, a method of manufacturing an LED bulb comprising: creating a plastic bulb-shaped shell; installing at least one LED in the plastic bulb-shaped shell; filling the shell with a plastic material, wherein the plastic material is thermally conductive; and curing the plastic material.

In accordance with a further embodiment, a method of manufacturing an LED incandescent bulb replacement, comprises: creating a plastic incandescent bulb-shaped shell; filling the shell with a plastic material and wherein the plastic material is thermally conductive, wherein the plastic material cures at a temperature below that which might damage the LEDs; installing at least one LED in the plastic material prior to curing; and curing the plastic material after the filling means and the installing means are completed.

In accordance with a further embodiment, a method of manufacturing an LED incandescent bulb replacement, comprises: creating a plastic incandescent bulb-shaped shell; installing at least one LED within the incandescent bulb-shaped shell; filling the shell with a plastic material and wherein the plastic material is thermally conductive, wherein the plastic material cures at a temperature below that which might damage the LEDs; and curing the plastic material after the filling means and the installing means are completed.

In accordance with another embodiment, an LED bulb comprises: a thermally conductive plastic bulb; at least one LED within the thermally conductive plastic bulb; and a base, wherein the base is dimensioned to be received within an electrical socket.

In accordance with a further embodiment, a method of manufacturing an LED incandescent bulb replacement, comprises: installing at least one LED into a bulb shaped mold; filling the mold with a thermally conductive plastic material; and curing the plastic material, wherein the plastic material cures at a temperature below that which might damage the at least one LED.

In accordance with a further embodiment, a method of manufacturing an LED bulb comprises: creating a plastic bulb-shaped shell; filling the shell with a thermally conductive material; installing at least one LED in the thermally conductive material prior to gelling the thermally conductive material; and gelling the thermally conductive material.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
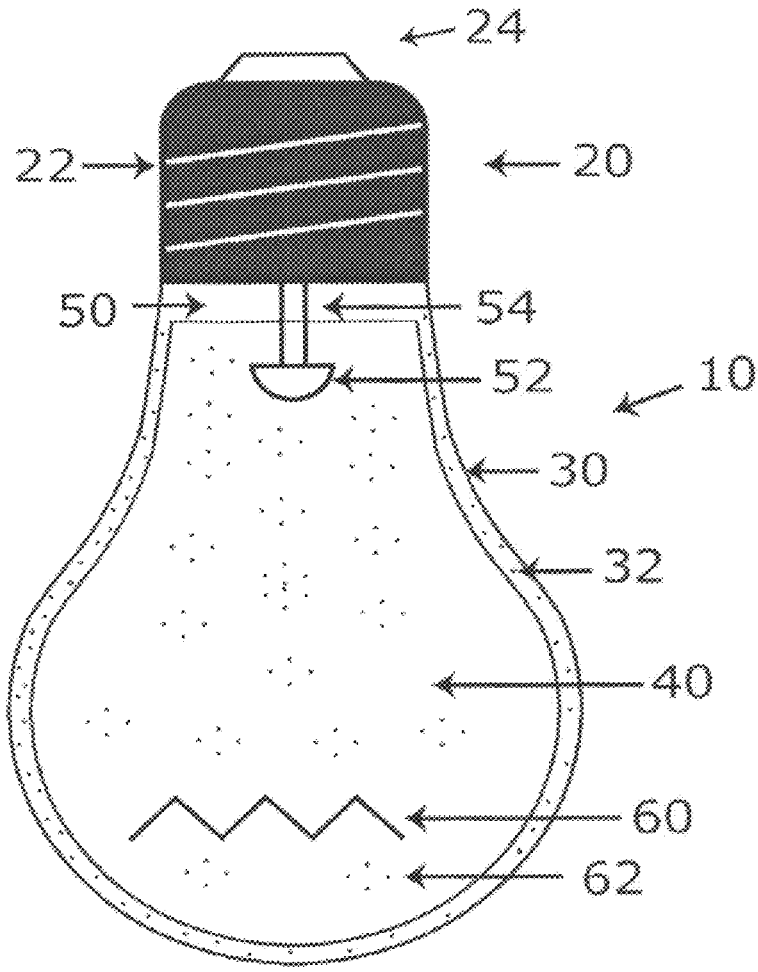
FIG. 1 is a cross-sectional view of an LED replacement bulb showing the light-emitting portion of the LED mounted in a plastic material.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a cross-sectional view of an LED replacement bulb 10 showing the light-emitting portion of the LED mounted in a plastic material according to one embodiment. As shown in FIG. 1, the LED replacement bulb 10 includes a screw-in base 20, a plastic shell 30, an inner portion 40 containing a transparent or translucent thermally conductive material, which may be any suitable plastic material 60, and at least one LED 50. It can be appreciated that the shell 30 (or enclosure) may be any shape, or any of the other conventional or decorative shapes used for bulbs, including but not limited to spherical, cylindrical, and "flame" shaped shells 30. Alternatively, the shell 30 can be a tubular element, as used in fluorescent lamps or other designs.

The screw-in base 20 includes a series of screw threads 22 and a base pin 24. The screw-in base 20 is configured to fit within and make electrical contact with a standard electrical socket. The electrical socket is preferably dimensioned to receive an incandescent or other standard light bulb as known in the art. However, it can be appreciated that the screw-in base 20 can be modified to fit within any electrical socket, which is configured to receive an incandescent bulb, such as a bayonet style base. The screw-in base 20 makes electrical contact with the AC power in a socket through its screw threads 22 and its base pin 24. Inside the screw-in base 20 is a power supply (not shown) that converts the AC power to a form suitable for driving the at least one LED 50.

As shown in FIG. 1, the plastic shell 30 entirely encases the plastic material 60 within the inner portion 40 of the LED replacement bulb 10. The shell 30 also encases at least the light-emitting portion 52 of the at least one LED 50, with the connecting wires 54 coming out through the shell 30 through a sealed connection to the power supply.

The bulb-shaped shell 30 is preferably formed of a plastic, liquid plastic or plastic like material, such as polycarbonate. However, it can be appreciated that shell 30 can be constructed of any suitable plastic material. In addition, the shell 30 is preferably transparent, however, it can be appreciated that the shell can also contain a dispersion material 32 dispersed throughout the shell 30. The dispersion material 32 is preferably configured to disperse the light from the light-emitting portion 52 of the LED 50. The dispersion of the light source from the light-emitting portion 52 prevents the bulb 10 from appearing to have a point source or a plurality of point sources of light with a plurality of LEDs 50. It can be appreciated that the shell 30 can also contain dispersion material 32 to assist with changing the bluish color of a typical LED die to a more yellowish color, which more closely resembles the light from normal incandescent bulbs.

In another embodiment, the shell 30 and/or the plastic material 60 can include a plurality of bubbles (not shown), wherein the bubbles disperse the light from the at least one LED 50. In yet another embodiment, a dye (not shown) can be added to the shell 30 or the plastic material 60 within the shell 30, wherein the dye shifts the light of the at least one LED 50 from a first color spectrum to a second color spectrum.

As shown in FIG. 1, the shell 30 is filled with a thermally conductive plastic material 60, such as a liquid plastic or other suitable material. In a preferred embodiment, the plastic material 60 cures at a temperature below that which can cause damage to the LEDs 50. The plastic material 60 may also be of the same material as the shell. The plastic material 60 may also be a gel. During use, the plastic material 60 acts as the means to transfer the heat power generated by the at least one LED 50 to the shell 30, where it can be removed by radiation and convection, as in a normal incandescent bulb. The plastic material 60 can be transparent, or may contain a dispersion material 62 to assist with dispersing the light from the light-emitting portion 52 of the LED 50. The dispersion material prevents the bulb 10 from appearing to have a point source or a plurality of point sources of light with a plurality of LEDs 50. In addition, the dispersion material 62 dispersed in the plastic material 62 may be used to change the bluish color of the light-emitting portion 52 of the LED 50 to a more yellowish color, more closely resembling the light from normal incandescent bulbs. The plastic material 60 is also preferably electrically insulating.

The at least one LED 50 is preferably installed in the plastic material prior to the curing of the plastic material or prior to the addition of plastic material. Once the at least one LED 50 is installed in the plastic material 60, but still prior to curing, the electrical contacts for powering the LEDs 50 are brought out. The leads are connected to the power source for the LEDs 50, which will typically be included inside the remainder of the bulb 10. The power source is preferably designed to be compatible with pre-existing designs, so that the bulb 10 may directly replace traditional bulbs without requiring any change in the pre-existing fixture. The bulb 10 has metallic contacts mounted to it, which will provide the power to the power source for the at least one LED 50.

Figure 2:
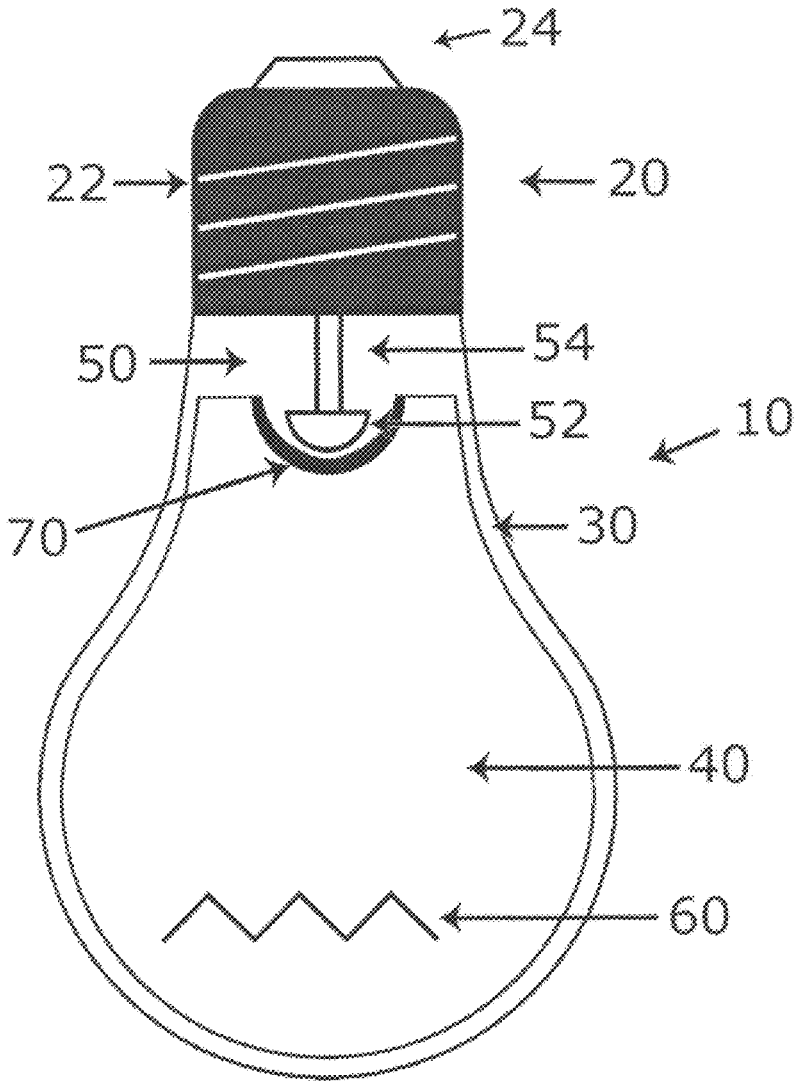
FIG. 2 is a cross-sectional view of an LED replacement bulb showing the LED embedded in a plastic shell, while remaining in thermal contact with a plastic material.

FIG. 2 is a cross-sectional view of an LED replacement bulb 10 showing at least one LED 50 embedded in the plastic shell 30, while remaining in thermal contact with the plastic material 60. The LED replacement bulb 10 can include a screw-in base 20, a shell 30, an inner portion 40 containing a plastic material 60, and at least one LED 50 with a light-emitting portion 52 and a pair of connecting wires 54. The screw-in base 20 makes electrical contact with the AC power in a socket through its screw threads 22 and its base pin 24. Inside the screw-in base 20 is a power supply (not shown) that converts the AC power to a form suitable for driving the at least one LED 50. The LED or LEDs 50 are comprised of two parts, the connecting wires 54 that connect them to the power supply, and the light-emitting portion 52. The shell 30 entirely encases the plastic material 40. The shell 30 also encases the at least one LED 50, with the connecting wires 54 connecting to the power supply. In this embodiment, the at least one LED 50 is thermally connected to the plastic material 40 through a thin shell-wall 70. The shell-wall 70 provides a low thermal resistance path to the plastic material 60 for the heat dissipated by the at least one LED 50.

Figure 3:
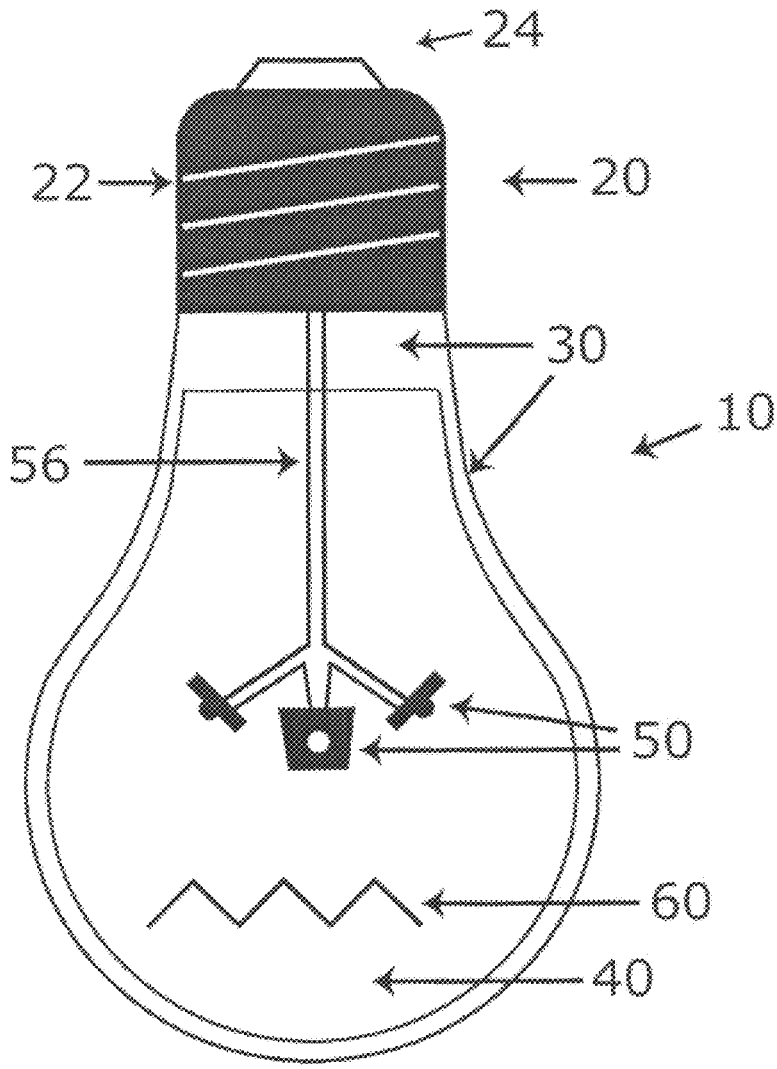
FIG. 3 is a cross-sectional view of an LED replacement bulb showing a plurality of LEDs mounted in a plastic material.

FIG. 3 is a cross-sectional view of an LED replacement bulb 10 showing a plurality of LEDs 50 mounted in the plastic material 60 according to a further embodiment. The LED replacement bulb 10 includes a screw-in base 20, a shell 30, an inner portion 40 containing a plastic material 60, and a plurality of LEDs 50 with an LED support 56. The screw-in base 20 makes electrical contact with the AC power in a socket through its screw threads 22 and its base pin 24. Inside the screw-in base 20 is a power supply (not shown) that converts the AC power to a form suitable for driving the at least one LED 50.

The plurality of LEDs 50 in this embodiment are preferably at least 3 or 4 LED dies arranged to distribute the light source in a suitable configuration. In one embodiment, the plurality of LEDs 50 can be arranged in a tetrahedral configuration. The at least one LED or the plurality of LEDs 50 are comprised of two parts, the connecting wires 54 that connect them to the power supply, and the LED or LEDs 50 themselves. The connecting wires 56 are stiff enough to function as support for the LED or LEDs 50, and also form the interconnects between the LEDs 50 when there are multiple devices. The shell 30 entirely encases the plastic material 60. The shell 30 also encases the LED or LEDs 50, with the connecting wires 56 coming out through the shell 30 through a sealed connection to the power supply. It can be appreciated that in another embodiment, the support may be a different material from the interconnections or connections.

Figure 4:
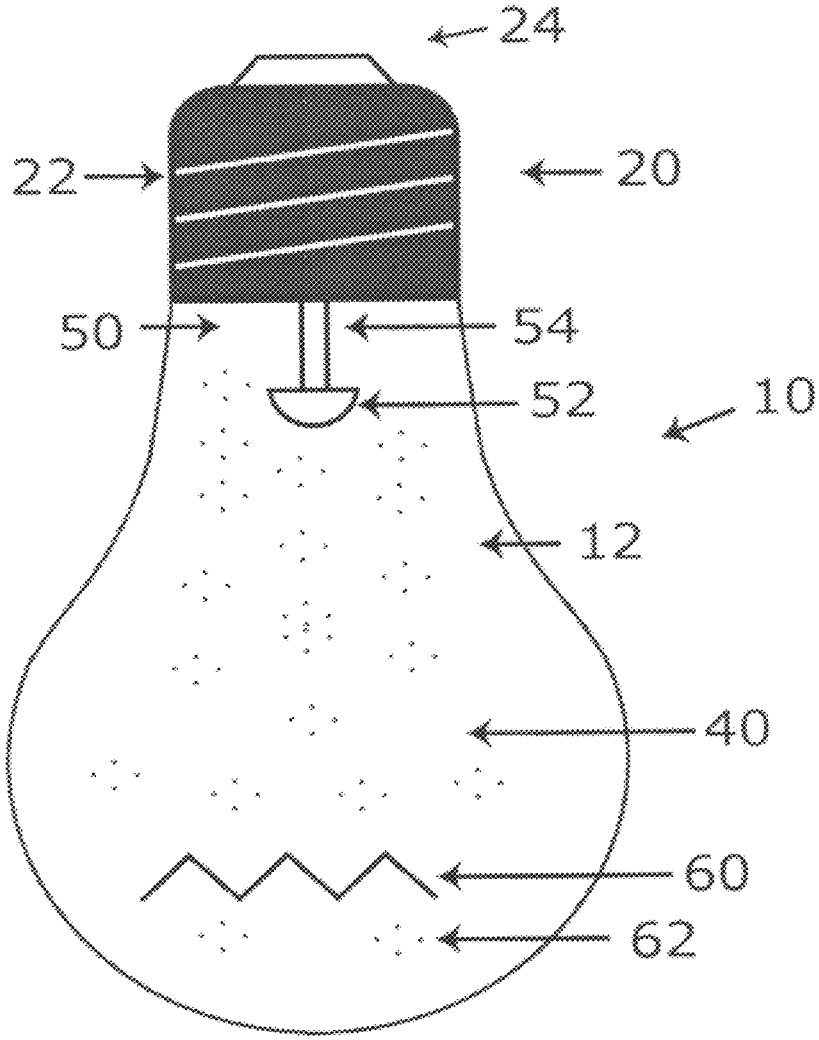
FIG. 4 is a cross-sectional view of an LED replacement bulb showing the LED in a thermally conductive plastic bulb.

FIG. 4 is a cross-sectional view of an LED replacement bulb 10 showing the LED 50 in a thermally conductive plastic bulb 12. As shown in FIG. 4, the LED bulb 10 can include a thermally conductive plastic bulb 12, at least one LED 50 within the bulb 12, and a screw-in base 20. The base 20 include a series of screw threads 22 and a base pin 24, wherein the screw threads 22 and the base pin 24 are dimensioned to be received within a standard electrical socket. Typically, if the plastic material 60 and the shell 30 as shown in FIG. 1 of the bulb 10 are made of the same material, instead of a defined separation between the shell 30 and the thermally conductive plastic material 60, the shell 30 and the thermally conductive plastic material 60 can form a thermally conductive bulb 12. In addition, if the same material is used for the shell 30 and the plastic material 60, the LED bulb 10 can be formed by placing the screw-in base 20, which includes the series of screw threads 22 and the base pin 24, and the at least one LED 50 into a mold and adding the plastic material 60 thereto. The plastic material 60 is then cured at a temperature below that which might damage the at least one LED 50. Subsequent processing to the plastic material 60 may result in the formation of a shell subsequent to the curing step. Alternately, subsequent processing to the plastic material 60 may add a shell subsequent to the curing step.

It can be appreciated that the LED replacement bulbs as shown in FIGS. 1-4 are shown as replacement bulbs for standard incandescent bulbs, however, the bulbs 10 and methods as set forth herein can be used for any lighting system, including flashlights, headlights for automobiles and/or motorcycles, and/or lanterns.

It will be also be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An LED bulb comprising:

a shell;

a thermally conductive material within the shell, wherein the thermally conductive material is a liquid material;

at least one LED within the shell;

a dispersion material distributed throughout the liquid material, wherein the dispersion material is configured to shift the color of light emitted from the at least one LED and the dispersion material is configured to disperse the light from the at least one LED; and a base configured to fit within a socket.

2. The LED bulb as set forth in claim 1, wherein the base comprises a series of screw threads and a base pin, wherein the screw threads and base pin are dimensioned to be received within a standard electrical socket.

3. The LED bulb as set forth in claim 1, wherein the shell is a plastic material.

4. The LED bulb as set forth in claim 1, wherein at least a portion of the at least one LED is mounted within the thermally conductive material.

5. The LED bulb as set forth in claim 1, wherein the at least one LED is thermally connected to the thermally conductive material through a shell-wall.

6. The LED bulb as set forth in claim 1, wherein the shell is configured to disperse the light from the at least one LED.

7. The LED bulb as set forth in claim 1, further comprising a color shifting material within the shell, wherein the color shifting material is configured to shift light from the at least one LED from a first color spectrum to a second color spectrum.

8. The LED bulb as set forth in claim 1, further comprising a dye added to the shell, wherein the dye is configured to shift the light of the at least one LED from a first color spectrum to a second color spectrum.

9. The LED bulb as set forth in claim 1, wherein the dispersion material is configured to shift light from the at least one LED from a first color spectrum to a second color spectrum.

10. The LED bulb as set forth in claim 1, wherein the thermally conductive material is a liquid plastic.

11. A method of manufacturing an LED bulb comprising:

creating a shell;

installing at least one LED in the shell; and filling the shell with a thermally conductive material, wherein the thermally conductive material is a liquid material, a dispersion material is distributed throughout the liquid material, the dispersion material is configured to shift the color of light emitted from the at least one LED, and the dispersion material is configured to disperse the light from the at least one LED.

12. The method as set forth in claim 11, further comprising attaching a base to the shell, wherein the base is dimensioned to be received within a standard electrical socket.

13. A method of manufacturing an LED bulb comprising:

creating a shell;

installing at least one LED in the shell; and filling the shell with a gel, wherein the gel includes a dispersion material distributed throughout the gel, the dispersion material is configured to shift the color of light emitted from the at least one LED, and the dispersion material is configured to disperse the light from the at least one LED.

14. The method as set forth in claim 13, wherein the gel has the characteristics to color shift the light.

15. The method as set forth in claim 13, wherein the shell includes a color shifting material, wherein the color shifting material is configured to shift light from the LED from a first color spectrum to a second color spectrum.

16. The method as set forth in claim 13, further comprising adding a dye to the shell, wherein the dye is configured to shift the light of the at least one LED from a first color spectrum to a second color spectrum.

17. The method as set forth in claim 13, further comprising adding a dye to the gel, wherein the dye is configured to shift the light of the at least one LED from a first color spectrum to a second color spectrum.

18. A method of manufacturing an LED bulb comprising:

creating a shell;

filling the shell with gel; and installing at least one LED in the gel filled shell, wherein the gel includes a dispersion material distributed throughout the gel, the dispersion material is configured to shift the color of light emitted from the at least one LED, and the dispersion material is configured to disperse the light from the at least one LED.

19. The method as set forth in claim 18, wherein the gel has the characteristics to disperse and/or color shift the light from the at least one LED.

20. The method as set forth in claim 18, wherein the shell includes a color shifting material, wherein the color shifting material is configured to shift light from the LED from a first color spectrum to a second color spectrum.

21. The method as set forth in claim 18, further comprising adding a dye to the shell, wherein the dye is configured to shift the light of the at least one LED from a first color spectrum to a second color spectrum.

22. The method as set forth in claim 18, further comprising adding a dye to the gel, wherein the dye is configured to shift the light of the at least one LED from a first color spectrum to a second color spectrum.

* * * * *